United States Patent [19]

McMillan

[11] 4,252,278

[45] Feb. 24, 1981

[54] FIRE HOSE NOZZLE

[76] Inventor: Clyde H. McMillan, 421 Pickwick Pl., Valparaiso, Ind. 46383

[21] Appl. No.: 38,346

[22] Filed: May 11, 1979

[51] Int. Cl.[3] ..... B05B 1/30

[52] U.S. Cl. ..... 239/583

[58] Field of Search ..... 239/451, 452, 453, 456–460, 239/569, 583

[56] References Cited

U.S. PATENT DOCUMENTS

| | | | |
|---|---|---|---|
| 807,025 | 12/1905 | Henry . | |
| 2,583,233 | 1/1952 | Russell . | |
| 2,806,741 | 12/1957 | Fishelson . | |
| 2,955,766 | 10/1960 | Nielsen . | |
| 3,012,733 | 12/1961 | Allenbaugh . | |
| 3,061,199 | 10/1962 | Billeter . | |
| 3,116,018 | 12/1963 | Kunz . | |
| 3,540,657 | 11/1970 | Thompson . | |
| 3,640,465 | 2/1972 | Hicks | 239/583 |
| 3,684,192 | 8/1972 | McMillan . | |
| 3,863,844 | 2/1975 | McMillan | 239/459 X |

*Primary Examiner*—Richard A. Schacher

*Attorney, Agent, or Firm*—Merriam, Marshall & Bicknell

[57] ABSTRACT

A fire hose nozzle having a central tubular body member and tubular forward and rear body members carried at the respsective ends of said central body member. A pressure control cylinder is coaxially mounted in the tubular body member and a hydraulically balanced, tubular, slider member is mounted in the central body member for axial movement between an upstream position wherein the downstream end of the slider member is spaced from a cone on the upstream end of the pressure control cylinder, and a downstream position wherein the downstream end of the slider member engages the cone of the pressure control cylinder and shuts off flow through the nozzle. Manually movable means on the exterior of the central tubular body member is connected to the slider member and permits a user of the nozzle to vary the position of the downstream end of the slider member in the tubular body member with respect to the cone of the pressure control cylinder to thus modulate the rate of the flow of fluid through the nozzle.

14 Claims, 7 Drawing Figures

FIRE HOSE NOZZLE

Extinguishing fires with water is far more complicated than it would appear on the surface. In one tactic known as "blitzing", a large amount of water is applied to the blaze as quickly as possible, then much smaller amounts are used to put out any small remaining blazes. Other tactics may utilize a stream of water applied directly to the blaze or a fog or mist may be required. While there are as many tactics for fighting fires as there are fire fighters, most involve the application of varying amounts of water in each stage of the fire. To further complicate matters, this water must often be applied from a considerable distance to protect the firemen from the heat of the blaze. Since the water is usually applied by projecting a stream from a nozzle, the flow characteristics of the stream must be carefully controlled or excessive turbulence may cause it to break up, thus limiting the distance over which it can be projected. In the past, there have been difficulties in modulating the flow rate of a stream without introducing excessive turbulence. There have also been difficulties in maintaining the required "reach" of a stream in spite of variations in the supply pressure. The object of the present invention is to overcome these difficulties and provide an apparatus which will enable the nozzleman to modulate the flow easily, conveniently and without introducing excessive turbulence into the stream and to maintain a substantially constant velocity flow in spite of variations in supply or pressure.

SUMMARY OF THE INVENTION

It has been found that these objects may be attained by an improved nozzle having a rear body member with a passage therethrough and a forward body member having a fluid pressure regulator disposed therein by providing a slidable slider member or slider having a passage therethrough, wherein the slider member is slidable into an upstream position wherein the passage in the slider member communicates with the passage in the rear body member and wherein the slider member is slidable into a downstream position so that a shoulder on the downstream end of the slider member abuts the upstream end of the pressure regulator means to form a substantially watertight seal. In preferred embodiments, all of the passages are substantially axially symmetric. In a more preferred embodiment, the objects of the invention are obtained by a nozzle including a rear body member having a substantially cylindrical passage therethrough, a slider member slidable from an upstream position to a downstream position, the slider member having a passage therethrough, wherein a portion of that passage is enlarged and mates with said rear body member to form a substantially watertight seal and wherein another portion of that passage is cylindrical and has substantially the same diameter as the passage in the rear body member and is abuttable with the passage in the rear body member when the slider is in the upstream position. Mounted downstream of the slider is a forward body member having an annular passage therethrough, the inside diameter of the annulus being greater than the inside diameter of the passage through the slider, the slider being abuttable with the forward body portion to form a substantially watertight seal. Preferably, all embodiments include a resiliently mounted baffle at the mouth of the nozzle which maintains a substantially constant pressure within the nozzle, thus maintaining the exit stream at substantially constant velocity in spite of variations in the supply pressure.

DETAILED DESCRIPTION OF THE PREFERRED EMBODIMENT

Figure 1:
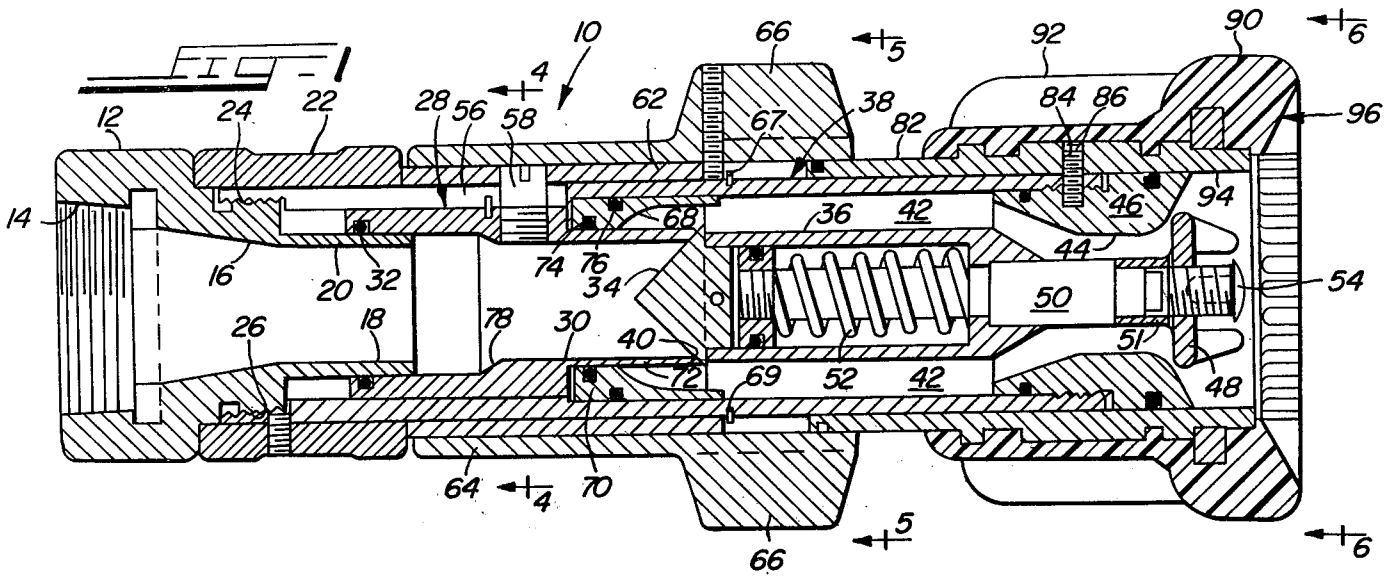
FIG. 1 is a schematic sectional view of an improved nozzle of the present invention illustrating the valve in the closed position.

In FIG. 1, water flows into nozzle 10 through tail piece 12 having threads 14 formed therein. Upon entering nozzle 10, the water flows through neckdown chamber 16 which terminates in cylindrical passage 18 formed by hollow cylindrical tip 20 of tailpiece 12. Tailpiece 12 having external threads 26 is fastened to internal threads 24 formed in body member 38. If desired, any convenient grip such as a pistol grip or other handle may be mounted on band 22 mounted circumferentially around body member 38. A slider member or slider 28 having cylindrical passage 30 therethrough forms the heart of the valve which allows modulation of the flow without causing excessive turbulence. An enlarged portion of the slider 28 fits over and slidingly engages the exterior of cylindrical tip portion 20 of tailpiece 12. O-ring 32 insures a substantially watertight seal between the exterior of cylindrical tip portion 20 and the interior of slider 28. As can be seen by comparing FIGS. 1 and 2, the enlarged portion of slider 28 can be telescoped into the annular void defined between the interior of body member 38 and the exterior of hollow cylindrical tip portion 20. When slider 28 is in the downstream position as shown in FIG. 1, the downstream end of slider 28 is abutted against cone 34 mounted upon pressure control cylinder 36 disposed within tubular body member 38. The mouth of cylindrical passage 30 in slider 28 has chamfered shoulder 40 formed therein so that a substantially watertight seal is formed when slider 28 is in the downstream position. Preferably cone 34 is comprised of a material such as Delrin®, an acetal resin sold by E. I. duPont.

Figure 2:
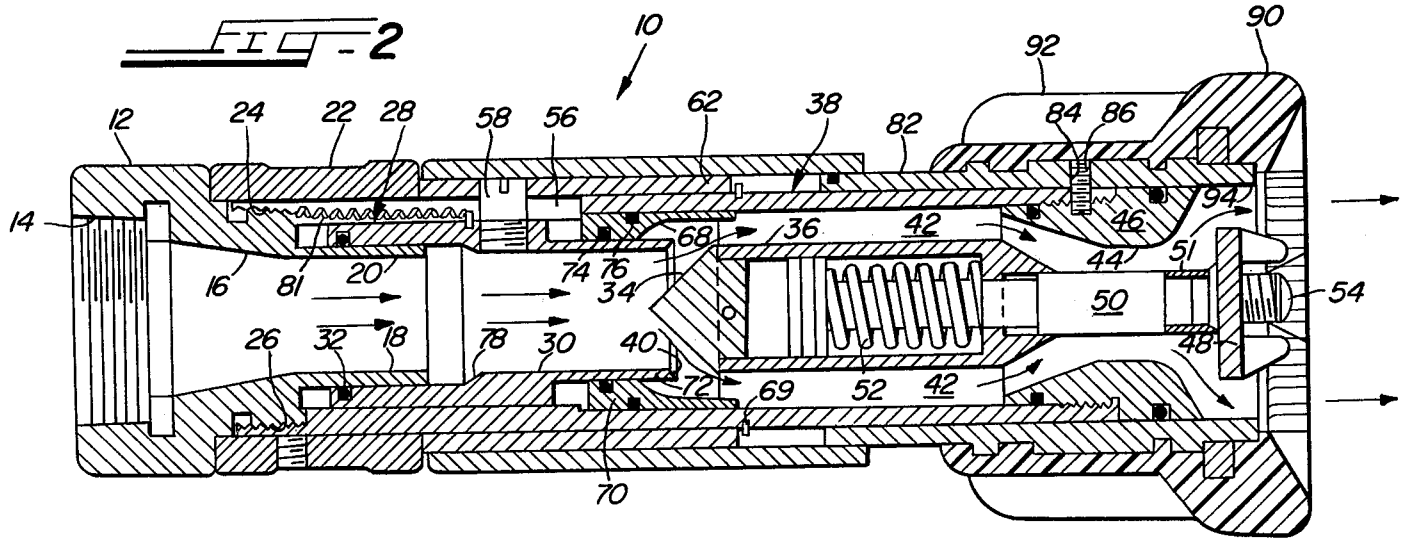
FIG. 2 illustrates the flow through the nozzle of FIG. 1 when the valve is in a partially open position.

When slider 28 is in the upstream position as shown in FIG. 2, water flows through passage 30 in slider 28 over cone 34, past axial vanes 42 mounted on the exterior of pressure control cylinder 36 and into throat 44 formed in neck down insert 46. As shown in FIG. 1, in the off position, the clearance in throat 44 is preferably maintained at around 0.010 inches by inner baffle 48 which is mounted on post 50 which is reciprocally supported on the center line of tubular body member 38 by pressure control cylinder 36. Collar 51 surrounds post 50 to minimize turbulence inducing discontinuities. Spring 52 urges post 50 towards the left thus urging inner baffle 48 to the left and restricting flow. As shown in FIG. 2, when the pressure of the water is exerted against inner baffle 48, this pressure overcomes the resistances of spring 52 and shifts baffle 48 and post 50 to the right thereby further opening the throat of nozzle 10. As pressure within the nozzle tends to exceed the desired constant pressure, such as by an increase in the flow caused by a further opening of the throttling valve, baffle 48 opens toward the right, providing a greater flow area to pass the increased flow at essentially constant pressure. Conversely, if flow is diminished as by throttling or otherwise diminishing the supply, baffle 48 closes toward the left, reducing the flow opening, thereby maintaining an essentially constant pressure.

Inner baffle 48 is threadably attached to post 50 in such a fashion that it may be manually positioned for either of two purposes, yet cannot be accidentally removed due to the presence of locking screw 54. One desirable purpose is to permit the baffle to be manually fully opened quickly (with the nozzle shut off) to permit dumping and/or flushing of entrapped debris, after which the baffle may then be quickly restored to normal operating position. Another desirable, and indeed critical, function is to provide manual override of the automatic pressure regulation when abnormal circumstances (such as breakdown of the pumping engine) result in inadequate pressure being supplied to the nozzle for normal operation. In such adverse circumstances, a nozzleman may protect himself by manually opening the baffle 48 a turn or two thereby to obtain an increased volume at whatever pressure may be available from a supplying fire hydrant. Thus, the nozzleman may manually obtain the best possible compromise stream to cover escape, or if his position is tenable, until normal operating pressure is restored, in which case the sliding valve is momentarily closed to permit rescrewing baffle 48 to its normal operating position.

Pressure control cylinder 36 is supported within tubular body member 38 by axial vanes 42 which also serve to quiet any turbulence caused by flow through the valve formed by slider 28 and cone 34.

Figure 3:
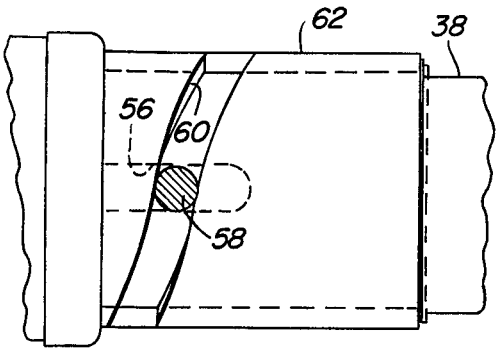
FIG. 3 is a top view illustrating the helicoid which controls operation of the valve.
Figure 4:
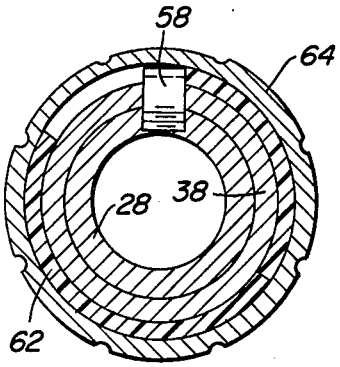
FIG. 4 is a sectional view along line 4—4 in FIG. 1.
Figure 5:
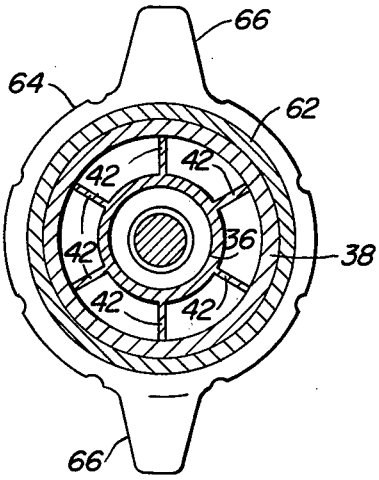
FIG. 5 is a sectional view along line 5—5 in FIG. 1.
Figure 6:
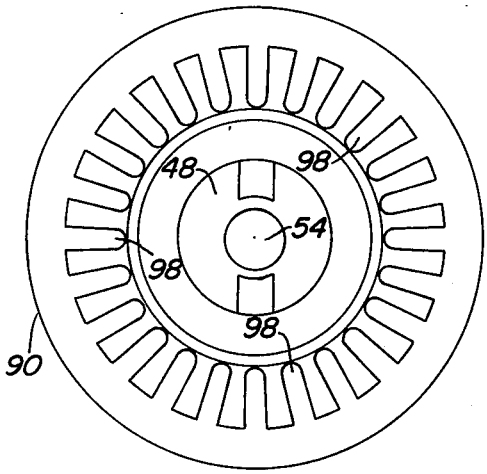
FIG. 6 is a view along line 6—6 in FIG. 1.
Figure 7:
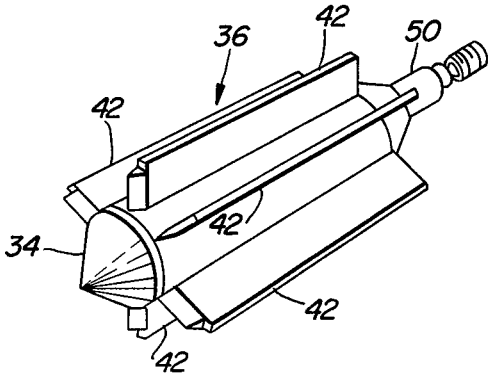
FIG. 7 is a perspective view illustrating the vaned pressure regulator.

Slider 28 is carried within body 38 which has longitudinal slot 56 formed therein. Pin 58 projects from slider 28 through longitudinal slot 56 (FIGS. 1, 2 and 3) in body 38 and engages helical slot 60 in rotatable sleeve 62 which is fixed to collar 64 having lugs 66 mounted thereon. It will be apparent that upon rotation of collar 64, sleeve 62 will also rotate and since pin 58 passes through both helical slot 60 in rotatable sleeve 62 and through longitudinal slot 56 in body 38, rotation of sleeve 62 forces pin 58 to move within longitudinal slot 56 and thereby shifts slider 28 within body 38. Thus, the mouth or shoulder 40 of slider 28 can be abutted against cone 34 by rotation of collar 64 and can similarly be withdrawn. The collar 64, sleeve 62, longitudinal slot 56, helical slot 60 and pin 58 thus comprise means for effecting movement of the slider member 28 in the tubular body member 38. Rotatable sleeve 62 is maintained in place surrounding body 38 by band 22 and ring 67 mounted within slot 69 in the exterior of tubular body member 38. It will be appreciated that while this mechanism provides an especially compact, lightweight and easily sealed means of positioning slider 28, other means, such as a trigger mechanism, could be used. The motion of slider 28 to the right is limited by cone 34. The internal diameter of the left end 70 of internal collar 68 is such that internal collar 68 will telescope over right end 72 of slider 28 while the outside diameter of internal collar 68 is such that it may be disposed within body 38. O-rings 74 and 76 are provided to prevent or minimize leakage.

There are two important features which this arrangement makes possible which should be especially mentioned. The first is that this arrangement is completely axially symmetric so that turbulence inducing nonsymmetries are not introduced into the flow stream. The second is that when the valve is closed with the water inside the nozzle pressurized, the only pressure force acting to restrain opening of the valve is the longitudinal component of the force on the neckdown region of the slider indicated at 78. As the projection of this area is small, the pressure force resisting opening will also be small. If desired this neckdown region may be eliminated but the positive closure feature is then lost. When the valve is open and water is flowing, this force on the neckdown region 78 (if included) will be substantially counterbalanced by the force on chamfered shoulder 40 and the annular end of the slider indicated at 80, thus the net force will be small and relatively independent of the flow rate, therefore modulation of the flow by moving the slider will be relatively easy. If desired, the force on slider 28 can be varied by including resilient means such as spring 81 in the cavity bounded by body member 38, slider 28, band 22 and end pin 83 on slider 28. It will be apparent that any desired equilibrium position may be obtained by properly sizing spring 81, so that the valve may be urged open, urged shut or urged into some intermediate position.

Another advantage of this arrangement resides in the fact that it is now possible to arrange the interior surfaces so that turbulence inducing discontinuities may be minimized. While slight turbulence will be induced at the downstream mouth of the slider when it is partially open, this turbulence is very minimal as compared to that induced by such valves as ball valves, gate valves, and the other valves commonly encountered in nozzles. The turbulence induced is quickly reduced by the action of vanes 42 which have sharp leading edges to further minimize turbulence. Elsewhere, turbulence is further controlled by the fact that radical accelerations due to gross changes in cross sectional area are avoided since the cross sectional area of the flow channel is approximately constant (within a factor of about 2 throughout the nozzle up to throat 44 and the small gap formed by inner baffle 48 in the mouth of the nozzle. Perhaps the most important advantage of the arrangement is that it allows the nozzleman to apply the desired amount of water to the blaze at all times without worring about variations in supply pressure or excessively decreasing the reach of his stream when it is desired to throttle the flow.

After the water passes inner baffle 48, it issues as a jet which is shaped by shaper sleeve 82 encircling and longitudinally movable on barrel 38. Shaper sleeve 82 has a helicoid slot 84 cut into it which engages pin 86 which passes through body 38 into shaper insert 46. The exterior of shaper sleeve 82 is covered by rubber bumper 90 having ribs 92 formed in its exterior. The throat of shaper 82 is formed by sidewall 94 which is substantially cylindrical while the mouth 96 is substantially conical and has teeth 98 projecting inwardly therefrom. When the operator desires to cast a jet, he rotates sleeve 82 so that it is in its rightmost position as shown in FIGS. 1 and 2. In that case, the water jet issuing is affected principally by the throat's cylindrical sidewall 94 and thus can be cast over great distances. When shaper sleeve 82 is retracted by rotation so that sidewall 94 is covered by shaper insert 46, then the jet impacts upon and is broken up by teeth 98 in bumper 90 resulting in a spray, fog, or mixture of the two.

As my invention, I claim:

1. In an improved nozzle for projecting a jet of fluid over considerable distances, said nozzle being of the type having a body member having a longitudinal passage formed therein and flow restrictor means disposed within said passage in said body member, the improvement comprising a slider member disposed within said body member and having a passage therethrough, said slider member being slidable from a downstream position to an upstream position, the downstream end of the slider member being abuttable with the upstream end of said flow restriction means to form a substantially watertight seal when the slider member is in its downstream position, and means for preventing flow through said nozzle except through said passage in said slider member.

2. The nozzle of claim 1, wherein said passages are substantially axially symmetric.

3. A nozzle for projecting fluids comprising a tubular body member, a concentric flow restrictor member disposed within said tubular body member, an axially slidable slider member disposed within said tubular body member, said slider having a passage formed therein, means for effecting movement of said slider member to a position abutting against said restrictor member and preventing flow through said passage in said slider member, said last mentioned means also effecting movement of said slider to a position spaced from said restrictor member to permit flow through said nozzle while said slider member is spaced from said restrictor, and means for preventing flow through said nozzle through said passage in said slider.

4. The nozzle of claim 3, wherein said concentric flow restrictor defines a surface of revolution the axis of which is substantially coincident with the centerline of said tubular body member.

5. The nozzle of claim 4, wherein the passage through said slider defines a surface of revolution the axis of which is substantially coincident with the centerline of said tubular member.

6. The nozzle of claim 5, including collar means mounted in said tubular body member and adapted to slidably mate with and support said slider member, said collar means having a passage into which said passage in said slider opens, said passage in said collar means also opening into the passage defined between said restrictor and said tubular body member.

7. The nozzle of claims 5 or 6, wherein said means for preventing flow through said nozzle except through said passage in said slider member comprises a rear body member having a passage therethrough opening into said passage in said slider.

8. The nozzle of claim 3, wherein said passage in said slider member is substantially cylindrical.

9. The nozzle of claim 6, wherein a neck down insert is disposed in said tubular body member downstream from said flow restrictor member, said flow restrictor member is supported within said tubular body member by a plurality of longitudinal vanes extending radially from said flow restrictor member and engaging said collar means and said neck down insert, said vanes engaging the interior of said tubular body member and maintaining the flow restrictor in a position which is substantially concentric with the tubular body member.

10. The nozzle of claim 3, wherein the sum of the areas of the slider on which the pressure of fluid will result in a force in the downstream direction is substantially equal to the sum of the areas of the slider on which the pressure of fluid will result in a force in the upstream direction.

11. The nozzle of claim 3, 6 or 10, wherein all passages in said nozzle are substantially axially symmetric and free of turbulence inducing non-symmetries.

12. In an improved nozzle for projecting a jet of fluid over considerable distances including a body member having a longitudinal passage therethrough, and a flow restrictor means disposed within said passage in said body member, the improvement comprising an axially slidable member disposed within said body member and having a passage therethrough, said slidable member being slidable from a closed position abutting said flow restrictor means, wherein the passage through said slidable member is blocked, to an open position wherein the slidable member is spaced from said flow restrictor means so that fluid may flow through said passage in said slidable member and through said passage in said body member, the net force on said slidable member in the upstream direction being substantially balanced by the net force in the downstream direction when fluid is flowing through said nozzle.

13. The nozzle of claim 12, further including resilient means mounted within said body member for urging said slidable member into an open position.

14. The nozzle of claim 12, further including resilient means mounted within said body member for urging said slidable member into a closed position.

* * * * *

UNITED STATES PATENT AND TRADEMARK OFFICE

CERTIFICATE OF CORRECTION

PATENT NO. : 4,252,278

DATED : February 24, 1981

INVENTOR(S) : Clyde H. McMillan

It is certified that error appears in the above-identified patent and that said Letters Patent are hereby corrected as shown below:

In the Abstract, line 3, "respsective" should read --respective--.

Column 5, line 29, before "through" should appear --except--.

Signed and Sealed this

*Twenty-second* Day of *June 1982*

[SEAL]

*Attest:*

GERALD J. MOSSINGHOFF

*Attesting Officer*

*Commissioner of Patents and Trademarks*